United States Patent [19]

Zemlo et al.

[11] Patent Number: 4,925,067

[45] Date of Patent: May 15, 1990

[54] DISPENSER CLOSURE

[75] Inventors: Bridgett Zemlo, Glendale Heights; Richard J. Petro, Mokena; David N. Moore, Plainfield, all of Ill.

[73] Assignee: Phoenix Closures, Inc., Naperville, Ill.

[21] Appl. No.: 213,332

[22] Filed: Jun. 30, 1988

[51] Int. Cl.[5] ..... B67D 3/00

[52] U.S. Cl. ..... 222/480; 222/485; 222/561; 222/565

[58] Field of Search ..... 222/480, 502, 503, 559, 222/561, 565, 485, 486

[56] References Cited

U.S. PATENT DOCUMENTS

| | | | |
|---|---|---|---|
| D. 138,343 | 7/1944 | Granese | D44/22 |
| 1,870,390 | 8/1932 | Sprigings | 222/480 X |
| 1,884,813 | 10/1932 | Nicholls | 222/480 |
| 1,959,874 | 5/1934 | Mills | 221/11 |
| 1,993,364 | 3/1935 | Ellstrom | 222/480 |
| 2,186,962 | 1/1940 | Foss | 222/561 X |
| 2,254,581 | 9/1941 | Punte | 221/64 |
| 2,826,345 | 3/1958 | Thomsen | 222/485 |
| 3,036,746 | 5/1962 | Hagen | 222/480 |
| 3,093,272 | 6/1963 | Esthus | 222/480 |
| 3,140,019 | 7/1964 | Barr | 222/480 |
| 3,144,180 | 8/1964 | Phillipps et al. | 222/480 |
| 3,144,181 | 8/1964 | Setecka | 222/480 |
| 3,239,111 | 3/1966 | Croce | 222/480 |
| 3,317,087 | 5/1967 | Landis | 222/480 |
| 3,332,586 | 7/1967 | Amburgey | 222/480 |
| 3,499,588 | 3/1970 | Bartilson et al. | 222/565 |
| 3,912,128 | 10/1975 | Ziemann et al. | 222/541 |
| 4,257,537 | 3/1981 | Uhlig | 222/485 X |
| 4,274,568 | 6/1981 | Otterson | 222/480 |
| 4,611,725 | 9/1986 | Kacalieff | 222/480 X |

*Primary Examiner*—Joseph J. Rolla
*Assistant Examiner*—Gregory L. Huson
*Attorney, Agent, or Firm*—Welsh & Katz, Ltd.

[57] ABSTRACT

A dispenser closure for a container includes a body having a generally planar top portion and a peripheral skirt portion depending therefrom to form a cap-like formation, and the top portion is provided with at least one sifter opening, a larger opening for spooning or pouring and a pair of vertically projecting slide guides located thereon in diametrically opposed relation to each other. A substantially planar solid slide plate is also provided and is adapted to slidingly engage the slide guides and to selectively expose either the sifter opening, the larger opening or to cover both the shifter and larger openings.

6 Claims, 2 Drawing Sheets

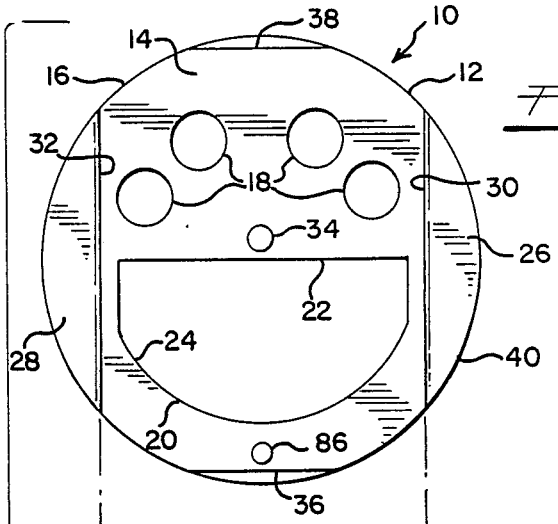
FIG. 1
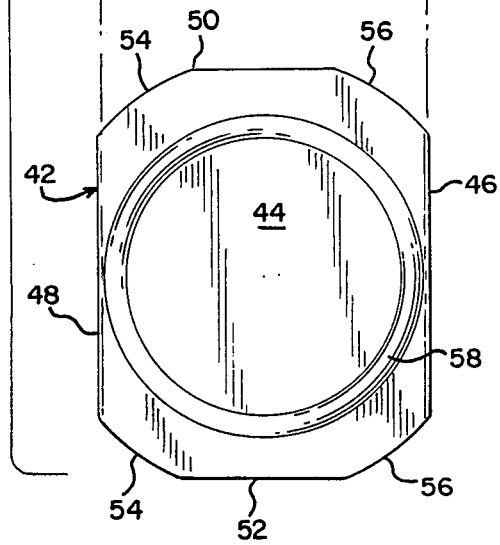
FIG. 2
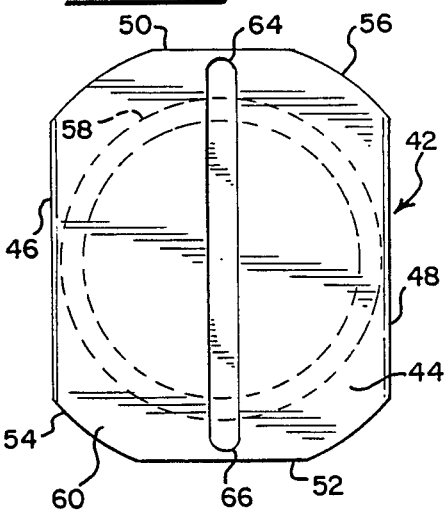
FIG. 3
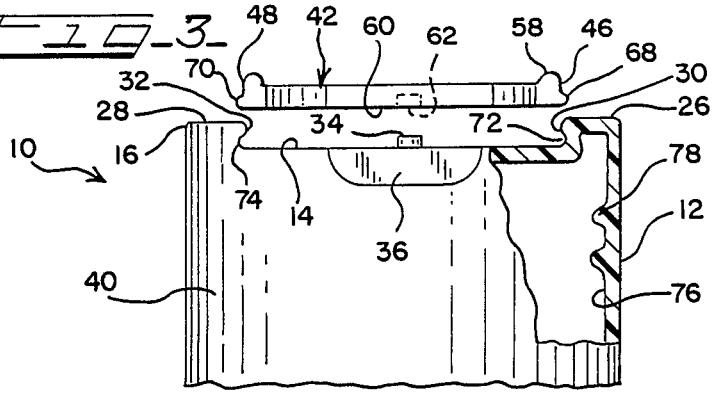

DISPENSER CLOSURE

BACKGROUND OF THE INVENTION

The present invention relates to closures for containers for spices or other condiments normally provided in particulate or granular form, and more particularly is related to a closure for a condiment container adapted for either sifting, pouring or spooning.

Friable particulate matter such as spices and other condiments normally is packaged in metal tins or glass or plastic jars. The closures of conventional tin-type containers have formations adapted for sifting, pouring and/or spooning. U.S. Pat. No. 1,959,874 discloses a tin-type condiment container including a closure having a cover plate and a slide plate adapted to slide over the cover plate. The cover plate is provided with a plurality of sifter openings at one end and a retractable spout for pouring at the other end. The slide plate is provided with a like plurality of sifter openings which may be placed in registry with the cover plate sifter openings and also has a spout opening which, depending on its position, may partially block the pivoting action of the metal spout to prevent the spout from extending for pouring. Thus, when it is desired to sift condiments from the container, the slide plate is manipulated so that the sifter openings of both the slide plate and the cover plate are in registry with each other. In this position, the spout is prevented from opening. In situations where pouring is desired, the slide plate is slid across the cover plate so that the retractable spout may be opened, and at the same time the sifter openings in the cover plate and slide plate are out of registry, thus preventing the escape of condiments from those openings while pouring. A major drawback of this design is the lack of any capability for spooning.

In the case of metal tin-type condiment containers currently available, it is conventional to provide an integral plastic closure having three separate openings, each with its own hinged snap-fit lid, one for sifting, one for pouring and one large enough to insert a measuring spoon therein. The user selects the most appropriate type of condiment distribution method and then opens the appropriate lid to distribute the condiment accordingly. The lids are designed so as to not disgorge condiments unless they are opened.

In the case of glass or plastic jars normally used as containers for spices, it is common to provide a detachable sifting fitment adapted to be snap-fit upon the open mouth of the jar. The jar is then capped by a plastic closure which is helically threaded to be attached to the jar's mouth. When pouring or spooning is desired, the fitment may be removed. The disadvantages of such conventional jar closures is that the sifting fitment may be easily lost, and that it is inconvenient to readily convert the container from pouring to sifting. A further disadvantage of prior art closures is that the pouring spout or spoon opening is not large enough to accommodate a wide range of sizes of measuring spoons. Thus, there is a need for an economically produced closure for a glass or plastic jar-type condiment container which provides the capability of readily converting from sifting to pouring and/or spooning and vice versa.

Accordingly, the present invention provides a closure for a jar-type container capable of being readily converted for either sifting or pouring and/or spooning.

SUMMARY OF THE INVENTION

A dispenser closure for a container includes a body having a generally planar top portion with a peripheral edge margin and an annular skirt portion depending therefrom, at least one sifter or pouring opening, a larger opening for spooning or pouring and a pair of diametrically opposed, vertically projecting slide guides; as well as a substantially planar solid slide plate being dimensioned to slidingly engage the slide guides to cover the top portion and being capable of selectively exposing either the sifter opening or the spoon opening. The closure of the invention may be further provided with a stop formation adapted to limit the degree of travel of the slide plate across the top portion of the body. The closure may be used to dispense spices, other condiments of a particulate nature, as well as all friable particulate matter.

BRIEF DESCRIPTION OF THE DRAWINGS

FIG. 1 is a plan view of the sifter closure of the invention showing the slide plate detached from the body;

FIG. 2 is a bottom view of the slide plate as shown in FIG. 1;

FIG. 3 is an exploded front elevation of the closure of FIG. 1 with a portion of the body cut away;

DESCRIPTION OF THE PREFERRED EMBODIMENT

Figure 4:
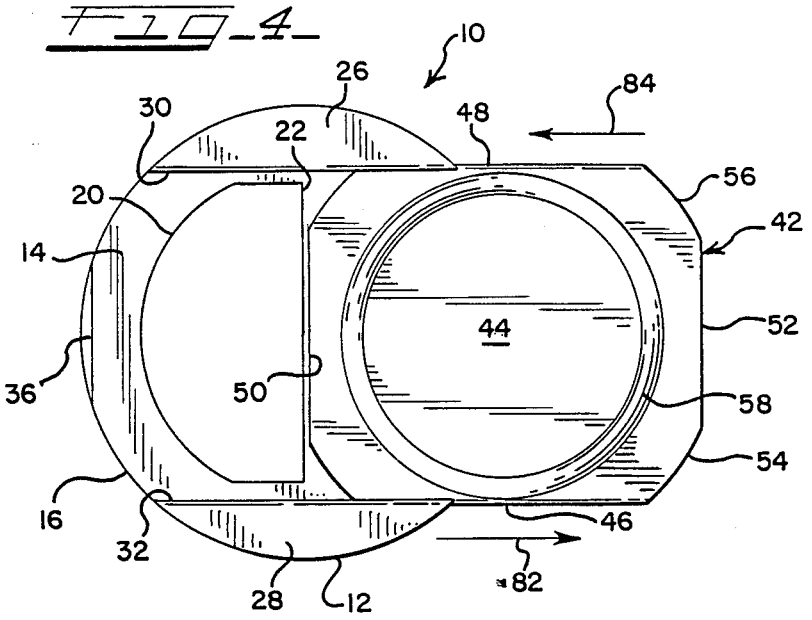
FIG. 4 is a plan view of the closure of the invention shown in the spooning or pouring position.

Referring to FIG. 1, the dispenser closure of the invention is indicated, and is designated generally by the reference numeral 10. The closure 10 includes a body 12 having a generally planar top portion 14 with a peripheral margin 16. The top portion 14 further includes at least one sifter opening 18. In the preferred embodiment, four generally circular sifter openings 18 are provided. The top portion 14 also includes a substantially larger 'D'-shaped spoon or pouring opening 20 having a substantially linear edge margin 22 and a substantially 'C'-shaped edge margin 24. Other shapes may be used for the openings 18 and 20 as may be found desirable. A pair of vertically projecting slide guides 26 and 28 are positioned near the periphery 16 of the top portion 14 and are located in generally diametrically opposed relationship to each other. Each vertically projecting slide guide 26, 28 is provided with a vertical face 30 and 32, respectively. A vertically projecting, substantially cylindrical boss 34 may be centrally located upon the top portion 14. A pair of thumb slots or flat spots 36 and 38 may optionally be located diametrically opposite each other on the periphery 16 of the body 12 and are located approximately 90 degrees from the vertically projecting slide guides 26, 28. The flat spots 36, 38 are located in an annular skirt 40 (best seen in FIG. 3) which depends from the outer periphery 16 of the body 12.

A slide plate 42 includes a solid body 44 having first and second side edges 46 and 48 which are in generally parallel relationship to each other, and first and second ends 50 and 52, respectively, each of which is provided with generally rounded edge margin portions 54 and 56, respectively. It will be seen that the slide plate 42 is dimensioned to cover the top or face portion 14 between the slide guides 26 and 28, the latter designed to be slidingly engaged by the side edges 46 and 48. Although the slide plate 42 is shown being inserted at the end of the body 12 nearest the spoon opening 20, the plate 42 may also be inserted at the end of the body 12 nearest the sifter openings 18. Thus, either end 50, 52 of the plate 42 may be inserted in either end of the top portion 14. Alternatively, the plate 42 may be snap-fit onto the top portion 14 from above. A vertically projecting annular rib 58 or other decoration may optionally be attached or integrally formed upon the top of the body 44. The body 12 and the slide plate 42 are preferably fabricated of a plastic material such as high density polyethylene, low density polyethylene, polypropylene or polystyrene, however, the use of other suitably rigid materials is contemplated.

For greater ease of sliding motion between the slide plate 42 and the body 12, each such component may be fabricated of a dissimilar material having specific characteristics, i.e., the slide plate 42 may be fabricated of material having a different coefficient of friction relative to the body 12 to facilitate the sliding motion or restrict such motion as desired. In one embodiment, it is contemplated that the closure 10 may have a polypropylene body 12 adapted to be used with a polyethylene slide plate 42. As a further alternative, the slide plate 42 may be fabricated of a transparent or translucent material which enables the user to accurately select the desired opening 18 or 20 which is best suited to the user's particular need. In some cases, it may be desirable to provide the body 12 and the slide plate 42 in dissimilar colors for ease of differentiating the contents of identically shaped containers.

Referring now to FIG. 2, the underside 60 of the slide plate 42 may be provided with an elongate groove 62 which is centrally located on the body 44 and is dimensioned to slidingly accommodate the boss 34 therein. The use of multiple grooves 62 and corresponding bosses 34 is also contemplated. The slot 62 is provided with a pair of truncated ends 64 and 66, each of which is rounded to correspond with the cylindrical shape of the boss 34. It will be evident that the ends 64, 66 of the slot 62 do not reach the front and rear ends 50, 52 of the slide plate 42. In an alternative embodiment (not shown), a boss may be provided on the underside of the plate 42, and may be adapted to engage a groove in the upper surface 14 of the body 12. In a further alternative embodiment, the slot 62 may include a linear series of detentes (not shown), which engage the boss 34 and thus permit the slide plate 42 to be fixedly placed in a desired partially or fully open position.

A locking boss 86 (best seen in FIG. may also be provided on the closure 10, such as on either end of the top surface 14 near the respective flat spots 36, 38, and in linear arrangement with the boss 34 where it can engage the slot 62 to prevent inadvertent opening of the closure !0. In the preferred embodiment, the locking boss 86 is relatively smaller in overall dimension than the boss 34 to permit the plate 42 to be slid thereover. If, as an alternative embodiment, the groove 62 is located in the body 12 and the boss 34 is provided on the underside 60 of the plate 42, the locking boss 86 may also be provided on the underside 60.

Referring now to FIG. 3, the slide plate 42 is provided with a linear rib or bead 68, 70 located along each side edge 46, 48 thereof. Correspondingly, the vertical faces 30, 32 of the slide guides 26, 28 are also each provided with a recess or groove 72, 74 designed to matingly engage the respective ribs 68, 70 and to provide a releasable snap-fit between the slide plate 42 and the slide guides 26, 28. If desired, the slide plate 42 may be captured in its sliding movement within the slide guides. In one embodiment, an interior surface 76 of the skirt 40 is provided with an integral helical thread formation 78. The thread formation 78 is designed to threadably engage the threaded outer upper rim of a suitable container such as a glass or plastic spice jar (not shown). A lower rim 80 of the skirt 40 defines an open lower end of the closure 10 which is adapted to allow the threaded end of the jar (not shown) to be inserted into the interior of the closure 10 for engagement with the thread formation 78. The closure 10 may also be a snap-fit closure, as known in the art.

Referring now to FIG. 4, in operation, the closure 10 is assembled by placing the slide plate 42 in releasably locked sliding engagement between the vertically projecting slide guides 26 and 28. In FIG. 4, the closure 10 is shown in the pouring or spooning position. In this position, the slide plate 42 has been moved laterally in the direction indicated by the arrow 82 from a closed position to reveal the spoon opening 20. The contents of the jar or container may now be removed, either by pouring or by inserting a measuring spoon (not shown) into the opening 20. The opening 20 is large enough to accommodate a variety of measuring spoons therein, and the linear margin 22 of the opening 20 is configured to permit a leveling off of the spooned contents to facilitate accurate measuring.

When sufficient spices or other condiments have been extracted from the container and out through the closure 10, the slide plate 42 may be moved by the user in the direction indicated by the arrow 84 to cover all openings 18 and 20 of the top portion 14 of the closure 10. It will be evident that when the slide plate 42 is moved to the position indicated in FIG. 4, that the sifter openings 18 are completely covered, preventing the escape of any condiments therefrom.

The extent of linear movement of the slide plate 42 in the direction indicated by the arrow 82 is limited by the interaction of the rounded edge 66 against the boss 34 which acts as a stop. With the rounded end 66 engaging the boss 34, the slide plate 42 may be maintained in a position to allow full accessability to the spoon opening 20 while covering all of the sifter openings lB. Thus the condiment or other contained product may be spooned out of the container or poured as desired.

The flat spots or thumb slots 36, 38 are designed to enable the user to secure a good grip upon the closure 10 and to obtain adequate leverage to manipulate the slide plate 42 in reciprocating fashion in either of the directions indicated by the arrows 82 and 84.

Figure 5:
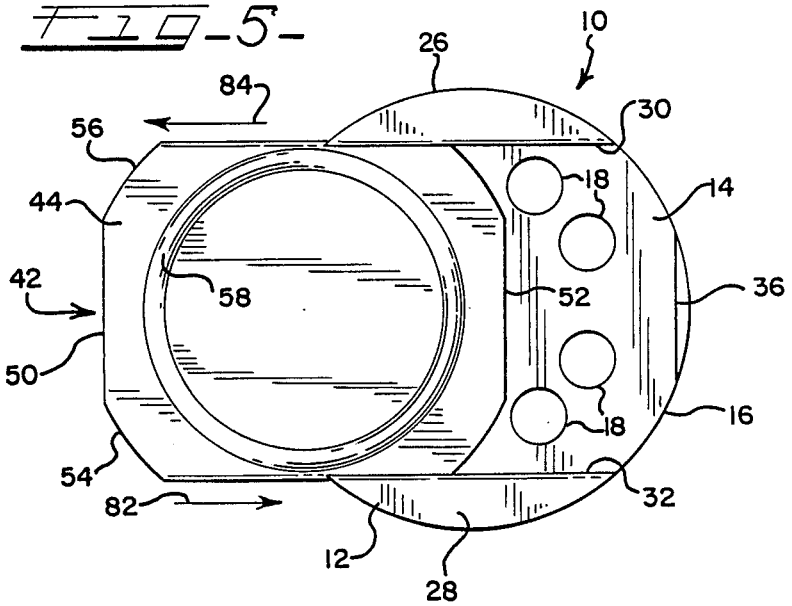
FIG. 5 is a plan view of the closure of the invention shown in the sifting position.

Referring now to FIG. 5, the closure 10 is shown in the sifting position wherein the slide plate 42 has been moved in the direction indicated by the arrow 84 to uncover the sifter openings 18. In similar fashion to the operation as disclosed above in FIG. 4, the extent of linear movement of the slide plate 42 in the direction indicated by the arrow 84 is limited by the interaction between the rounded end 64 of the slide plate 42 and the boss 34. Thus, in the sifting position as depicted in FIG. 5, all of the sifter openings 18 are uncovered, while the spoon opening 20 is totally covered, preventing the escape of any condiments or other particulate matter therefrom. When a sufficient amount of condiments or other particulate matter has been removed by sifting, the slide plate 42 may be manipulated in the direction 82 and returned to its original position to cover all openings, both the sifter openings 18 and the spoon or pouring opening 20.

Thus, the closure 10 of the invention discloses a closure apparatus designed to be used for condiment jars which provides the capability of either sifting, spooning or pouring by a simple movement of a slide plate 42. Although in the preferred embodiment, the slide plate 42 may be removed if desired, in operation the reciprocal movement thereof is designed to selectively provide exclusive access to either the sifter openings 18 or the spoon opening 20. The closure and slide plate may also be configured to prevent removal of the slide plate.

While a particular embodiment of the dispenser closure of the invention has been shown and described, it will be appreciated by persons skilled in the art that variations and modifications might be made without departing from the invention in its broader aspects and as set forth in the following claims.

What is claimed is

1. A dispenser closure for a container comprising:

a generally cylindrical body having a generally planar top portion with a peripheral edge margin and an annular skirt portion depending therefrom, said skirt portion having an interior threaded surface, said top portion being provided with at least one smaller sifter opening, a second larger generally "D-shaped" opening and a pair of diametrically opposed vertically projecting slide guides, said slide guides each having an elongate rounded recess located on opposing faces of said slide guides; and a substantially planar solid slide plate having an underside, a front end, a rear end, and a pair of side edges and being dimensioned to slidingly engage said slide guides to selectively expose said smaller opening or said second opening or to cover said smaller and second openings, said side edges each having an elongate rib with a rounded exterior for projection-free mating sliding engagement within said rounded recess of said respective slide guide, and stop means adapted to limit the sliding motion of said slide plate between said slide guides, said stop means including a boss centrally located upon said top portion of said body and an elongate linear groove centrally located in said underside of said slide plate, said groove having first and second truncated ends, said boss adapted to slidingly engage said corresponding groove and configured so that said boss may engage either of said truncated ends to stop the reciprocal sliding motion of said plate, said engagement of said ends by said boss being the only means of retaining said plate from sliding off of said body in either reciprocal direction.

2. The dispenser closure as defined in claim 1 wherein said slide plate is provided with a formation on a top surface thereof.

3. The dispenser closure as defined in claim 1 wherein said second opening has a spoon leveling edge.

4. The dispenser closure as defined in claim 1 wherein said body and said slide plate are fabricated of dissimilar materials.

5. The dispenser closure as defined in claim 1 wherein said body and said slide plates are provided in dissimilar colors.

6. The dispenser closure as defined in claim 1 wherein said boss is substantially cylindrical and said truncated ends of said groove are rounded.

* * * * *